US010661425B2

(12) United States Patent
Johansson

(10) Patent No.: US 10,661,425 B2
(45) Date of Patent: May 26, 2020

(54) ELECTRIC POWER TOOL WITH A SPRING FOR ATTENUATING REACTION FORCES

(71) Applicant: ATLAS COPCO INDUSTRIAL TECHNIQUE AB, Stockholm (SE)

(72) Inventor: Karl Göran Johansson, Saltsjö-Boo (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 217 days.

(21) Appl. No.: 15/578,004

(22) PCT Filed: Jun. 9, 2016

(86) PCT No.: PCT/EP2016/063230
§ 371 (c)(1),
(2) Date: Nov. 29, 2017

(87) PCT Pub. No.: WO2017/001167
PCT Pub. Date: Jan. 5, 2017

(65) Prior Publication Data

US 2018/0290283 A1 Oct. 11, 2018

(30) Foreign Application Priority Data

Jun. 30, 2015 (SE) ..... 1550913

(51) Int. Cl.
*B25F 5/00* (2006.01)
*B25B 21/00* (2006.01)
*B25B 23/147* (2006.01)

(52) U.S. Cl.
CPC ..... *B25F 5/001* (2013.01); *B25B 21/00* (2013.01); *B25B 23/147* (2013.01)

(58) Field of Classification Search
CPC ..... B25F 5/001; B25B 21/00; B25B 23/147
(Continued)

(56) References Cited

U.S. PATENT DOCUMENTS 5,692,575 A 12/1997 Hellstrom
7,721,390 B2 * 5/2010 Pfeiffer ..... B25D 17/043 173/162.2

(Continued)

FOREIGN PATENT DOCUMENTS

EP 0709168 A1 5/1996
EP 2106884 A2 10/2009
WO 2009044932 A1 4/2009

OTHER PUBLICATIONS

International Search Report (ISR) and Written Opinion dated Sep. 21, 2016 issued in International Application No. PCT/EP2016/063230.

*Primary Examiner* — Michelle Lopez
(74) *Attorney, Agent, or Firm* — Holtz, Holtz & Volek, PC

(57) ABSTRACT

An electric power tool includes an electric motor, an output shaft, a housing that houses the electric motor and at least part of the output shaft, and a reduction gear drivingly arranged between the electric motor and the output shaft. The reduction gear includes a load sensitive part that is rotatable in response to reaction forces created during operation of the power tool. A torsion spring, arranged to counteract any such rotation, includes a first end and a second end, the first end including a first connective interface that is rotationally lockable to a connective interface of the load sensitive part, and the second end including a second connective interface that is rotationally lockable with respect to at least one of the housing and the motor. At least one of the first and the second connective interfaces includes an element for prohibiting axial movement between the connected parts.

9 Claims, 1 Drawing Sheet

(58) Field of Classification Search
USPC ..... 173/162.1, 162.2, 217
See application file for complete search history.

(56) References Cited

U.S. PATENT DOCUMENTS

| | | | |
|---|---|---|---|
| 2009/0242226 | A1 | 10/2009 | Tokunaga |
| 2011/0048752 | A1 | 3/2011 | Sato |
| 2011/0232933 | A1 | 9/2011 | Kondo et al. |

* cited by examiner

ELECTRIC POWER TOOL WITH A SPRING FOR ATTENUATING REACTION FORCES

The invention relates to an electric torque delivering power tool with a spring arranged to receive reaction forces during a tightening operation.

BACKGROUND

In the art of tightening bolts or screws of a joint it is often desirable to tighten the joint as rapidly as possible. A conflict arises in the fact that the there is also a desire not to overshoot a set target torque. For a hard joint this may typically imply that a rapidly rotating motor needs to be retarded from a high angle velocity to a stop in a fraction of a lap as the torque starts to increase in a joint.

In order to decrease the tensions in a power tool it is known to arrange a spring to receive the reaction forces above a certain magnitude. Typically the motor is connected via at least one reduction gear to the output shaft. The gear may include a load sensitive part, i.e. a part that affected by the reaction torque from the output shaft. In a planetary gear the gear rim may typically constitute a load sensitive part that may be allowed to rotate when the torque of the motor is not completely installed into the joint.

The arrangement of such a spring is typically relatively space demanding and complex. Normally such an arrangement includes bearings and attachment pieces for securing the ends of the spring to the housing and the load sensitive part of the gear, respectively.

Hence, there is a need of an arrangement that offers flexibility with respect to the distribution of forces during a tightening operation, but which is easy to produce and mount to a complete and functional power tool.

SUMMARY OF THE INVENTION

An object of the invention is to provide an electric torque delivering power tool with a spring for attenuating reaction forces, which tool has a modular construction in the sense that it is easy to mount and that the parts of the power tool may be easily replaced.

This object is achieved by an electric power tool including an electric motor, an output shaft, a housing that houses the electric motor and at least part of the output shaft, and a reduction gear drivingly arranged between the electric motor and the output shaft. The reduction gear includes a load sensitive part that is rotatable in response to reaction forces created during operation of the power tool. A torsion spring is arranged to counteract any such rotation of the load sensitive part. The torsion spring includes, in one piece, a first and a second end, the first end including a first connective interface that is rotationally lockable to a connective interface of the load sensitive part of the reduction gear, and the second end including a second connective interface that is rotationally lockable with respect to the housing and/or the motor.

The fact that the torsion spring comprises connective interfaces makes it very easy to install into the power tool and to replace it when that is desired. Further, it drastically reduces the number of necessary parts inside the tool housing.

In a specific embodiment of the invention at least one of the first and a second connective interfaces includes an element for prohibiting axial movement between the connected parts. The element for prohibiting axial movement between the connected parts may be comprised of a threaded connection.

In another specific embodiment of the invention at least one of the first and a second connective interfaces includes splines, and specifically the first connective interface is a threaded connection and wherein the second connective interface is splined.

In yet another specific embodiment of the invention the reduction gear is a planetary gear comprising a sun gear, planet gears, and a gear rim, wherein the gear rim constitutes the load sensitive part.

Further the gear rim may be journalled in one bearing only and axially pre-stressed towards said bearing by the action of the torsion spring.

Other features and advantages of the invention will he apparent from the figures and from the detailed description of the shown embodiment.

SHORT DESCRIPTION OF THE DRAWINGS

In the following detailed description reference is made to the accompanying drawings, of which:

DETAILED DESCRIPTION OF THE SHOWN EMBODIMENT OF THE INVENTION

Figure 1:
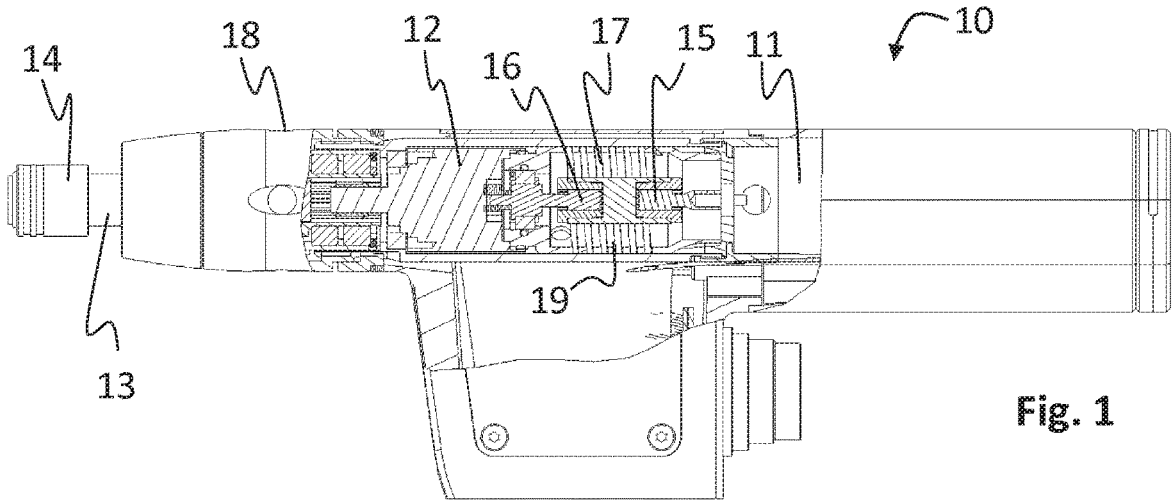
FIG. 1 shows a power tool according to a specific embodiment of the invention.

In FIG. 1 a power tool according to a specific embodiment of the invention is shown. The shown power tool 10 is an electric torque delivering power tool that includes a motor 11, that is connected via a power transmission including a reduction gear 12 to an output shaft 13. A bit holder 14 is arranged on the outer end of the output shaft for insertion of: a screw connectable bit.

The power transmission further includes a motor gear 15 that is connected via a coupling 17 to an input gear 16 in connection to the reduction gear 12. A housing 18 is arranged to house the motor 11 and the power transmission. The output shaft 13 extends through a front end of the housing 18. A torsion spring 19 is arranged to take up reaction forces between the reduction gear 12 and the housing 18. In the shown embodiment the torsion spring 19 is a helical spring that is tightly fitted inside a tubular portion of the housing 18. It may also be possible to use another type of spring, such as a coil spring.

Figure 2:
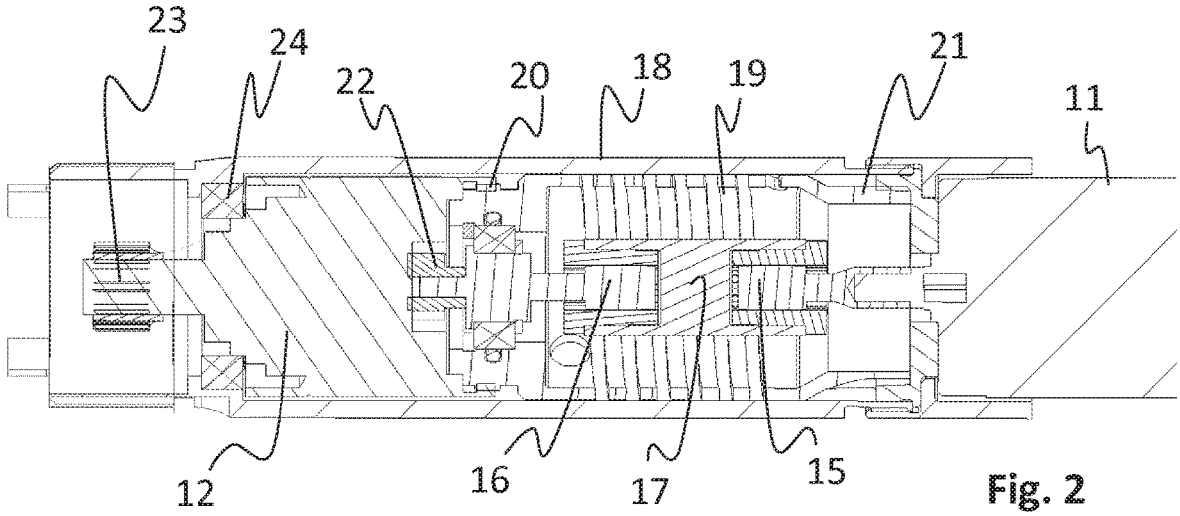
FIG. 2 is a sectional view of the power transmission of the power tool in FIG. 1.

In FIG. 2 a sectional view of the power transmission of the power tool 10 is shown. In this view it is apparent that the torsion spring has a first end 20 that is connectable to a load sensitive part of the reduction gear 12, and a second end 21 that is connectable to the motor 11 and/or housing 18 or an element that is fixed with respect to the housing. If the second end 21 is connectable to the motor 11 the motor will typically in turn be rotationally fixed with respect to the housing.

In the shown embodiment the reduction gear 12 is a planetary gear driven by a sun gear 22 that is connected to the input gear 16. An output gear 23 of the planetary gear is connected to the planet carrier (not shown) of the planetary gear. A gear rim (not shown) is arranged outside the planet carrier. The gear rim is arranged in a single bearing 24 with respect to the housing. Hence, the gear rim is not fixed to the housing, but is arranged to rotate against the action of the torsion spring 19. Hence, in the shown embodiment the gear rim constitutes the load sensitive part of the reduction gear 12.

Figure 3:
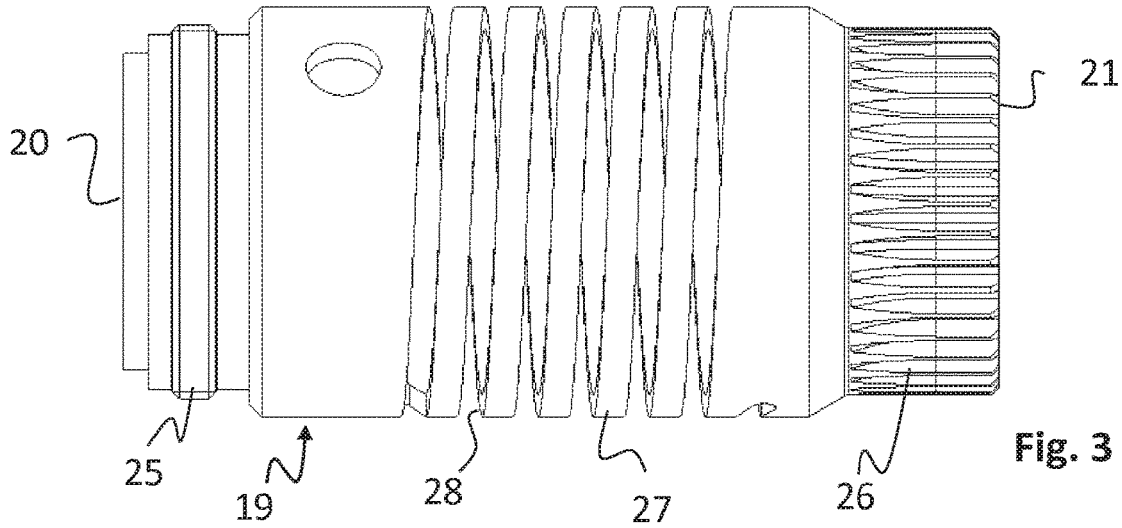
FIG. 3 is a view of a torsion spring in accordance with the invention.

FIG. 3 shows a specific embodiment of a torsion spring 19 in accordance with the invention. The torsion spring 19 has a first end 20 that is connectable to a load sensitive part of the reduction gear 12, and a second end 21 that is connectable to the housing. The first end 20 is provided with a first connective interface 25. The first connective interface 25 may either be a threaded portion, a bayonet coupling or any other connection that locks the first end of the torsion spring from both axial and rotational movement. The second end 21 of the torsion spring includes a second connective interface 26, which in the shown embodiment is comprised of splines. It is advantageous that the second connective interface 26 is secured from rotational movement but allows axial movement. Namely, such an arrangement radically facilitates mounting of the tool, in that the torsion spring in a first step is secured at the first connective interface 25, wherein the opposite end of the tool may be slided onto the second connective interface 26 of the torsion spring. The second connective interface 26 may be accomplished by splines, pin and groove, or any other connection that allows axial movement but secures the torsion spring from rotational movement.

The torsion spring 19 may advantageously be machined in one piece from a tubular member. The spring portion 27 is machined by removing material so as to form a helix with a uniform width and a uniform helix clearance 28. Preferably, the torsion spring is somewhat over-dimensioned such that it will be pre-stressed when arranged inside the tool. Such pre-stress is advantageous in many ways. Firstly, the pre-stress makes sure that no gaps or clearances exist and such that all details are held at place. Further, the pre-stress pushes the gear rim outwards against the bearing 24. A bearing should always have a pre-stress in one direction such that the balls of the bearing are in contact with both the inner and the outer races of the bearing. Conventionally, pre-stress an bearings are achieved by arranging two bearings with opposed pre-stress. However, with the pre-stress provided by the torsion spring 19 only one bearing is needed and the other may be dispensed with.

The simplicity with respect to the construction and mounting of the torsion spring 19 makes it possible to rapidly replace the torsion spring when needed. The power tool is generally produced in modules such that the motor, reduction gearings and the like may be exchanged for others with similar shape and interfaces so as to fit inside the housing and interact with other components. Torsion springs of different spring action may be accomplished by the use of a different material, or more appropriate by using a different dimension of the spring portion. A wider or thicker spring portion 27 is of course stiffer and adapted to higher torques.

As an example the reduction gear 12 may typically be comprised of either two planetary gear connected in series or one single planetary gear. A double planetary gear will of course provide double the effect, i.e. double the torque but half the rotational speed with respect to a single planetary gear. This may call for different torsion springs, as the forces the spring will have to be able support will be different and because the length of the gearing will change, which will have to be compensated for by the length of the torsion spring. The same may occur if a different motor of different size and/or effect is installed.

The fact that the torsion spring is constructed such that it may be easily installed and replaced facilitates mounting of the power tool and increases the overall modularity of the power tool.

Above, the invention has been described with reference to a specific embodiment. The invention is however not limited to this embodiment. It is obvious to a person skilled in the art that the invention comprises further embodiments within its scope of protection, which is defined by the following claims.

The invention claimed is:

1. An electric power tool comprising:

an electric motor;

an output shaft;

a housing that houses the electric motor and at least part of the output shaft; and a reduction gear, drivingly arranged between the electric motor and the output shaft, and comprising a load sensitive part that is rotatable in response to reaction forces created during operation of the power tool, wherein a torsion spring is arranged to counteract any such rotation of the load sensitive part, wherein the torsion spring, in one piece, includes a first end and a second end, the first end comprising a first connective interface that is rotationally lockable to a connective interface of the load sensitive part of the reduction gear, and the second end comprising a second connective interface that is rotationally lockable with respect to at least one of the housing and the motor, wherein at least one of the first and the second connective interfaces includes an element for prohibiting axial movement between said at least one of the first and second connective interfaces and a part connected to said at least one of the first and second connective interfaces, and wherein the element for prohibiting axial movement comprises a threaded connection.

2. The electric power tool according to claim 1, wherein at least one of the first and second connective interfaces includes splines.

3. The electric power tool according to claim 2, wherein the reduction gear is a planetary gear comprising a sun gear, planet gears, and a gear rim, and wherein the gear rim constitutes the load sensitive part of the reduction gear.

4. The electric power tool according to claim 3, wherein the gear rim is journaled only in one bearing and axially pre-stressed towards the bearing by action of the torsion spring.

5. The electric power tool according to claim 1, wherein:

the first connective interface is the threaded connection; and the second connective interface is splined.

6. The electric power tool according to claim 5, wherein the reduction gear is a planetary gear comprising a sun gear, planet gears, and a gear rim, and wherein the gear rim constitutes the load sensitive part of the reduction gear.

7. The electric power tool according to claim 6, wherein the gear rim is journaled only in one bearing and axially pre-stressed towards the bearing by action of the torsion spring.

8. The electric power tool according to claim 1, wherein the reduction gear is a planetary gear comprising a sun gear, planet gears, and a gear rim, and wherein the gear rim constitutes the load sensitive part of the reduction gear.

9. The electric power tool according to claim 8, wherein the gear rim is journaled only in one bearing and axially pre-stressed towards the bearing by action of the torsion spring.

* * * * *